United States Patent [19]

Whiting

[11] 4,063,508

[45] Dec. 20, 1977

[54] MUNITION DISPERSION BY INTERSTITIAL PROPELLING CHARGES

[75] Inventor: Richard A. Whiting, Minnetonka, Minn.

[73] Assignee: The United States of America as represented by the Secretary of the Air Force, Washington, D.C.

[21] Appl. No.: 664,620

[22] Filed: Mar. 9, 1976

[51] Int. Cl.[2] ..... F42B 25/16

[52] U.S. Cl. ..... 102/7.2; 102/69; 149/2; 149/19.4

[58] Field of Search ..... 149/2, 19.4; 102/7.2, 102/68, 69

[56] References Cited

U.S. PATENT DOCUMENTS

| | | | |
|---|---|---|---|
| 2,457,817 | 1/1949 | Harrell | 102/7.2 |
| 3,049,454 | 8/1962 | Stark | 149/2 |
| 3,198,677 | 8/1965 | Thomas | 149/2 |
| 3,309,247 | 3/1967 | Bluhm | 149/19.4 X |
| 3,507,722 | 4/1970 | Hamrick | 149/19.4 |
| 3,865,034 | 2/1975 | Boulter et al. | 102/68 X |
| 3,925,122 | 12/1975 | Berthmann et al. | 149/2 |
| 3,938,438 | 2/1976 | Anderson et al. | 102/7.2 |
| 3,951,068 | 4/1976 | Schroeder | 102/68 X |

*Primary Examiner*—Edward A. Miller

*Attorney, Agent, or Firm*—Joseph E. Rusz; William J. O'Brien

[57] ABSTRACT

This invention involves a means for dispersing submunitions from a cluster weapons system by utilizing a foamed propellant dispersion concept. The concept provides for the forced dispersion of clustered submunitions by high pressure gases generated rapidly and directly in the interstices of the submunition cluster by the controlled detonation of a propellant mixture containing cyclotetramethylenetetranitramine in a polyurethane foam.

2 Claims, 1 Drawing Figure

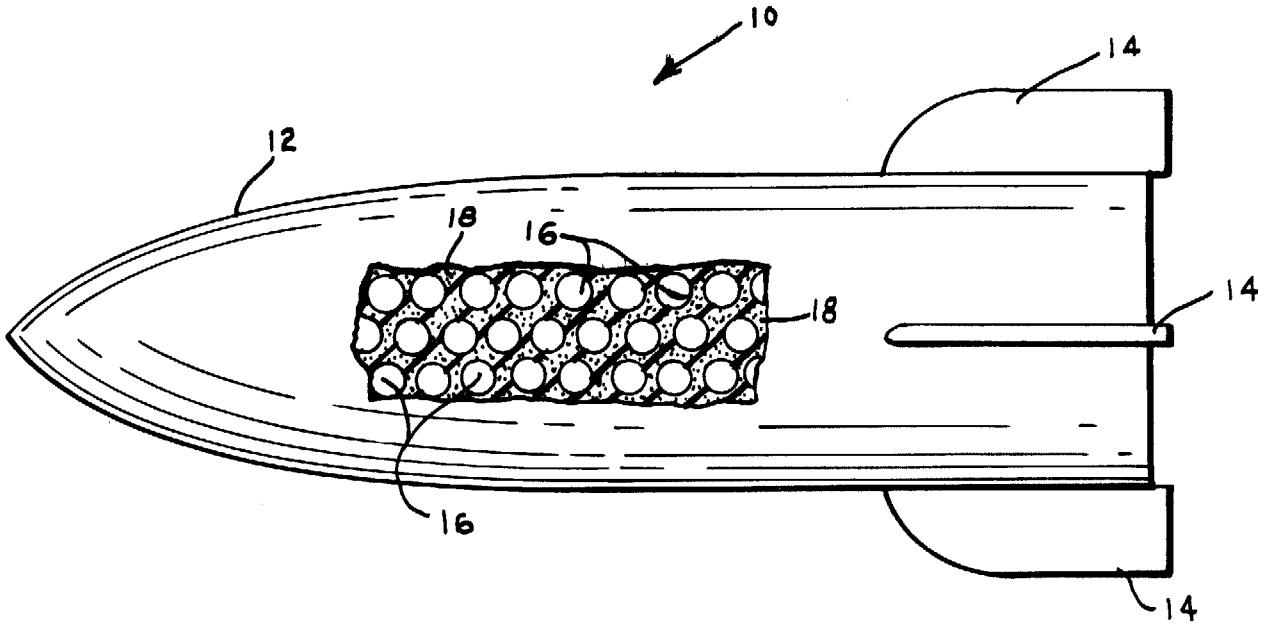
10
12
14
14
14
16
16
18
18

MUNITION DISPERSION BY INTERSTITIAL PROPELLING CHARGES

STATEMENT OF GOVERNMENT INTEREST

The invention described herein may be manufactured and used by or for the Government for governmental purposes without the payment of any royalty thereon.

BACKGROUND OF THE INVENTION

This invention relates to cluster weapons and to a means for effecting their dispersion. In a more particular aspect, this invention concerns itself with the forced dispersion of tightly clustered submunitions by a propellant/foam material.

With the recent interest in the tactical employment of cluster weapons and from an analysis of the operational requirements for future weapon systems, it has been found that a need exists to enhance the delivery flexibility of both guided and unguided cluster weapons and to maximize the benefits of terminally guided cluster weapons. This operational need dictates a requirement to develop a quick-acting submunition dispersion mechanism. A quick-acting dispersion mechanism is defined as one that does not affect weapon flight prior to warhead event and achieves required dispersion velocities within a fraction of a second after the event. In addition to the quick-acting feature, a dispersion mechanism capable of providing higher dispersion velocities than are attainable with current techniques is also needed. Higher dispersion velocities are defined as approximately twice those attainable with current augmented dispersion mechanisms, such as warhead spin, slings, and bladders.

In an attempt to satisfy the need for an effective submunition dispersion system, it was found that a polyurethane explosive propellant foam provided a feasible, quick-acting, high-velocity dispersion mechanism for dispersing clustered munitions.

Propellant dispersion is simple in concept. It consists of igniting energy rich gas generating grains of propellant locked in a low density plastic foam matrix. The propellant foam can be formed in panels and placed between cargo layers, or formed into a central core extending longitudinally in the dispenser to obtain rapid dispersion of the dispenser cargo, or cast into place in the interstices of an unconfined cluster of submunitions or projectiles located within a bomb casing.

At a predetermined time or position along the dispenser trajectory, the propellant is ignited. Resultant gas pressure ruptures the container or bomb casing and rapidly disperses the submunition cargo. The ignition, rupture, and cargo acceleration processes are completed within approximately two milliseconds. Controlling the amount of propellant ignited or the density of the foam material provides control of ground pattern size and uniformity.

Quick action and higher velocity dispersion are the major benefits of the propellant dispersion technique of this invention. These features overcome the negative characteristics of prior art dispersion techniques and provide the needed improvements in delivery flexibility and accuracy. In addition, propellant dispersion offers the following benefits, all of major concern in cluster weapons.

It is simple with a low end-item cost. There is a low weight to volume ratio resulting in an insignificant loss in cargo. From a safety standpoint, there is no degradation in weapon system safety. It has many applications and is compatible with a wide spectrum of weapons. It has particular utility for wide area munition dispersion from low altitude-high speed aircraft. It provides a very good arming environment since high pressure pulse can be used for rapid submunition arming. Also, the dispersement pattern for the submunitions can be easily controlled, thereby preventing voids in the pattern and optional detonating schemes can be employed to initiate a high or low dispersion velocity.

SUMMARY OF THE INVENTION

In accordance with this invention, it has been found that an effective means for the forced dispersion of submunitions from a cluster weapons system can be accomplished by locating a propelling charge, such as cyclotetramethylenetetranitramine in a polyurethane matrix, in the interstices of an unconfined cluster of submunitions. Upon the ignition of a conventional detonator, such as Detasheet or explosive cord, the propellant explodes producing a reasonably high pressure that ejects and disperses the submunitions. The present means for dispersing submunitions shows a number of advantages over prior art means. With this invention, there is instantaneous functioning, it is simpler, velocity of dispersion is higher and the foamed material acts as a packing material. It is much more compact, thereby providing for a greater payload; and it allows for a greater control of the dispersed pattern.

Accordingly, the primary object of the invention is to provide a means for uniformly dispersing submunitions over wide areas from a low altitude delivery event while, at the same time, keeping the parasitic weight at a relatively low fraction.

Another object of this invention is to provide a means for the effective dispersion of submunitions from a clustered weapons system.

Still another object of this invention is to provide a means for utilizing a foamed explosive material as a submunition dispersement mechanism.

Still another object of this invention is to provide a foamed propellant dispersion system that provides a feasible method for obtaining effective ground patterns, and satisfies the quick acting and high velocity dispersion requirements for future cluster weapons.

The above and still other objects and advantages of the present invention will become more readily apparent upon consideration of the following detailed description thereof when taken in conjunction with the accompanying drawing.

BRIEF DESCRIPTION OF THE DRAWING

The FIGURE represents a schematic view illustrating the propellant foam dispersion system of this invention.

DESCRIPTION OF THE PREFERRED EMBODIMENT

Pursuant to the above-defined objects, the present invention provides for a significant improvement in the dispersement of submunitions from a cluster weapons system. This is accomplished through the utilization of an interstitial propelling charge. The propelling charge comprises cyclotetramethylenetetranitramine, hereinafter referred to as HMX, supported in a foamed polyurethane plastic matrix which is located in the interstices of an unconfined cluster of submunitions.

Referring now to the drawing, there is shown a cluster weapon device 10 composed of a suitable bomb casing 12 with a conventional fin arrangement 14. A multiplicity of submunitions 16, either spherical or cylindrical, are randomly or selectively positioned within the interior of the casing 12. A foamed propelling charge 18 is located in the interstices between the unconfined cluster of submunitions 16. The foamed propellant can be placed in the interstices in the form of baffles, waffles or any convenient shape; or it can be cast into the interstices as a liquid material and then foamed in place by using a conventional foaming agent. A suitable detonating material, not shown, such as explosive cord or Detasheet, is placed within the bomb casing 12 to initiate detonation of the foamed propellant and thereby effectuate dispersion of the submunition clusters 16.

In order to demonstrate the feasibility of the forced dispersion of tightly clustered submunitions by the propellant/foam material of this invention, actual dispenser skin sections were loaded and used as demonstration models. These sections, approximately 30 inches long, contained 1.4-pound cylindrical dummy submunitions. The munitions were dispensed at velocities up to 500 feet/second. In terms of submunition weight, the parasitic weight fraction of the dispersion system was about 10 percent. The spheres were packed at 50 percent of the dispenser volume, and the cylinders were packed at 53 percent. The propellant/foam material of this invention contained 60 percent by weight HMX and 40 percent polyurethane foam. It was found that the HMX content of the mix should not be below about 60 percent, and its granulation should be close to that of Class A HMX.

A Rockeye MK 7 dispenser and a 2.5-inch spherical submunition was used to demonstrate propellant dispersion in flight tests. The rationale was that the Rockeye MK 7 was a fully qualified dispenser, and that the frangible Rockeye would demonstrate the feasibility of the invention. The payload was 340 spherical submunitions.

The cargo package consisted of nine cylindrical propellant foam waffles 15.7 inches in diameter. The explosive network consisted of an optional initiation scheme to achieve either high velocity dispersion by initiating a thin layer of Detasheet or low velocity dispersion by initiating the center explosive cord. Seven of the waffles were 7.0 inches thick with 30 cylindrical holes in each side to nest submunitions. The end waffle configuration was relatively simple and structurally strong enough to withstand the necessary handling. The 58-percent cargo efficiency by volume (240 submunitions) was good but not maximum. Although a waffle type propellant foam configuration was used in this test, other convenient configuration could be employed or the propellant foam could be cast within the submunition laden dispenser and then foamed in place.

In addition, the flight demonstration tests also consisted of a center core propellant foam configuration. Progressive testing and design evolution led to a bulk-loading technique wherein cylindrical or spherical submunitions were packed around a central core of propellant foam containing an explosive cord through its center. This technique is an effective, simple way to achieve quick setting dispersion with low velocity while increasing the payload. In the case of cylindrical submunitions, the increase was about 16 percent (280 versus 240 units).

The propellant foam developed for this invention was 60 percent by weight HMX and 40 percent polyurethane foam, with a nominal total density of 0.25 gram per cubic centimeter.

To attain high velocity dispersion from distributed propellant foam, the propellant waffle package is deflagrated rapidly by a high velocity shock wave inititated across the forward waffle by a thin layer of explosive sheet. If properly initiated, the reaction through the package is uniform and stable, resulting in high velocity separation and dispersion of the cargo.

The same distributed propellant foam configuration can be used to yield appreciably lower submunition velocities by using a different initiation technique to apply a reduced initial shock to the propellant. This is done by using explosive cord instead of explosive sheet. Because less propellant is initiated, low pressures are developed, resulting in a lower dispersion velocity.

The principle of central core dispersion of bulk-loaded submunitions is the same as that in low velocity dispersion by distributed propellant foam. A 3-inch-diameter core of propellant foam is initiated internally by an explosive cord. The pressure generated opens the dispenser and disperses the submunitions at a relatively low velocity.

In formulating the propellant foam which consists of an explosive HMX, and a two-part system of polyurethane foam, half of the HMX is mixed into each side of the foam system, and then the two sides are mixed and foamed into the cavity to be filled.

For example, the polyurethane foam used in propellant foam may be Pleogen 4120A/4120B from the Whittaker Corporation, Minneapolis, Minnesota. In this example, the specific gravity of the polyurethane foam is $1.24 \pm 0.01$ gm/cc for the "A" component and $1.18 \pm 0.01$ gm/cc for the "B" component, while the viscosity is $1740 \pm 150$ cps for the "A" component and $710 \pm 50$ cps for the "B" component. The cream and rise times for the polyurethane foam are $70 \pm 20$ seconds and $120 \pm 40$ seconds respectively, and foaming may be accomplished by using a trichloromonofluoromethene foaming agent.

The HMX explosive utilized in testing the invention was Type B, Class A Beta HMX from the Holston Army Ammunition Plant. The total moisture and volatiles in the HMX did not exceed 1.0 percent.

When tested in 2.5-inch diameter by 24 inches long schedule 10 steel pipe and initiated with 2.5-inch diameter C-4 Detasheet, the propellant foam propagated the full length of the pipe.

The compressive strength of the propellant did not exceed 100 lbs/in$^2$ at 160° F, and it was a uniform color with no voids greater than 0.5cc.

The Class A HMX explosive used in propellant foam was screened through 70 on 325 mesh sieves. Temperature control of $65 \pm 3°$ F and relative humidity control of $40 \pm 10$ percent is required for all areas where sealed containers of polyurethane or HMX are opened. The propellant form ingredients were weighed to $\pm 0.1$ gram of the calculated target weight. The premixes were prepared in separate containers and thoroughly mixed. The material was charged to the pressure vessels within five minutes of the beginning of mixing. The charging ram pressure was determined for each propellant foam lot, and then held constant to within 5 percent throughout production of the lot. The pressure that will provide an HMX flow rate through the propellant mixer of $15 \pm 2$ grams/second was used. The propellant foam blender was equipped with three mixing blades and operated at 2,900 RPM.

The method of preparing the propellant foam consisted of pre-blending approximately one-half of the HMX propellant in each of the two parts of the polyurethane foam system and then using rams to force the two premixes to mix together in a baffled orifice prior to injection into a mold, or an in-line mechanical mixing step may be used instead of the baffled orifice. In the mixing process, one-half of the HMX propellant is mixed with the "A" component of the polyurethane foam systems and the other half is mixed with the "B" component. This mixing step is done in different cylindrical vessels and promotes better breakup of any HMX agglomerates and better wetting of the HMX granules. These advantages occur because the time of this initial mixing step can be lengthened as appropriate because the foaming and cure reactions do not take place until the "A" and "B" components are mixed together. The diameter of these pre-mix cylinders are different. This occurs because, although the same weight of the "A" and "B" components are used, their densities and thus their volumes are different. Rams are then placed in the two cylinders containing the pre-mixes. These rams are driven at the same linear rate by one air cylinder whose regulated pressure is always adjusted to the same value. The two pre-mixes are forced out of cylinders by the rams through tubing and they are brought together in a "TEE" connector.

The two pre-mixes, now traveling together, pass through a chamber containing motor-driven, high-shear-rate mixer blades where they are thoroughly mixed together. After emergence from the mixing chamber, the propellant/foam mix is injected into the mold. Thus, the rams force the material all the way through the system into the mold until the pre-mix cylinders are emptied. Accordingly, a well-controlled, well-mixed, known amount of propellant/foam material is loaded into the mold for expansion and cure.

Using this process, a propellant/foam material was fabridated for compression testing at ambient temperature. These all contained 60 percent HMX by weight and 40 percent polyurethene. The average total density was 0.157 g/cm$^3$. The compressive strength measurements averaged 44.8 psi. If the compressive strength is assumed to be proportional to density, then at a total loading density of 0.25 g/cm$^3$ (HMX density at 0.15 g/cm$^3$) the compressive strength of such an HMX/polyurethane propellant/foam would be about 70 psi.

From a consideration of the foregoing, it can be seen that the present invention provides a novel technique for the tactical deployment of cluster weapons. The utilization of a propellant foam dispersion system provides a simple, economical, and effective means for dispersing the submunition projectiles contained in a cluster weapon. It is especially applicable for use with low altitude, lay-down delivery, guided dispensers where submunition pattern uniformity and control is of vital importance to tactical planners.

While the principle of this invention has been described with particularity, it should be understood that various alterations and modifications can be made without departing from the spirit of the invention, the scope of which is defined by the appended claims.

What is claimed is:

1. In a cluster weapon comprising a container and a multiplicity of submunitions positioned within said container as an unconfined cluster having interstices therebetween, the improvement which comprises having a gas generating, foamed, low density, polyurethane resin matrix positioned within and filling said interstices to form a quick acting mechanism for effecting the dispersion of said submunitions.

2. In a cluster weapon as defined in claim 1 wherein said matrix comprises an explosive mixture of about 60 percent by weight of cyclotetramethylenetetranitramine with the balance a foamed polyurethane resin.

* * * * *